US009759484B2

(12) United States Patent
Yang et al.

(10) Patent No.: US 9,759,484 B2
(45) Date of Patent: Sep. 12, 2017

(54) CENTRIFUGAL MOISTURE REMOVAL DEVICE

(71) Applicants: FU DING ELECTRONICAL TECHNOLOGY (JIASHAN) CO., LTD., Zhejiang (CN); HON HAI PRECISION INDUSTRY CO., LTD., New Taipei (TW)

(72) Inventors: Ming-Lu Yang, New Taipei (TW); Xiao-Xing Ren, Jiashan (CN); Jun-Feng Yao, Jiashan (CN); Long Yu, Jiashan (CN)

(73) Assignees: FU DING ELECTRONICAL TECHNOLOGY (JIASHAN) CO., LTD., Jiashan (CN); HON HAI PRECISION INDUSTRY CO., LTD., New Taipei (TW)

( * ) Notice: Subject to any disclaimer, the term of this patent is extended or adjusted under 35 U.S.C. 154(b) by 536 days.

(21) Appl. No.: 14/517,154

(22) Filed: Oct. 17, 2014

(65) Prior Publication Data

US 2015/0113822 A1 Apr. 30, 2015

(30) Foreign Application Priority Data

Oct. 29, 2013 (CN) ..... 2013 2 0668719 U

(51) Int. Cl.
*F26B 5/08* (2006.01)

(52) U.S. Cl.
CPC ..... *F26B 5/08* (2013.01)

(58) Field of Classification Search
CPC ..... F26B 5/08; F26B 11/022
USPC ..... 34/58, 312
See application file for complete search history.

(56) References Cited

U.S. PATENT DOCUMENTS 3,257,732 A * 6/1966 Webster ..... F26B 5/08 34/58
3,417,582 A * 12/1968 Hertig ..... D06F 37/22 68/210
6,644,859 B2 * 11/2003 Korting ..... F26B 11/022 384/549

* cited by examiner

*Primary Examiner* — Jiping Yuen
(74) *Attorney, Agent, or Firm* — Steven Reiss

(57) ABSTRACT

A centrifugal moisture removal device includes a rotating mechanism and a fixing mechanism. The rotating mechanism includes a rotating bracket and a rotary driving member. The rotating bracket includes two sleeving portions. The fixing mechanism includes two positioning members, two clamping members, and two line driving members. Each clamping member includes a moving staff, an elastic member, and a sensing member. A first end portion of the moving staff passes through a sleeving portion and is mounted on a positioning member. The elastic member is sleeved on the moving staff. A first end portion of the elastic member resists the sleeving portion. A second end portion of the elastic member resists a second end portion of the moving staff. Each line driving member is set above the second end portion of a moving staff. The sensing member senses when the workpiece arrives at the positioning member.

20 Claims, 4 Drawing Sheets

CENTRIFUGAL MOISTURE REMOVAL DEVICE

FIELD

The present disclosure relates to a moisture removal device, particularly to a centrifugal moisture removal device configured to remove residual water on workpieces.

BACKGROUND

In a process of dewatering workpieces, a dewatering device can be set apart from a product line. The workpieces can be manually transported to the dewatering device before dewatering or possibly taken away from the dewatering device manually after dewatering.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout several views.

DETAILED DESCRIPTION

Figure 1:
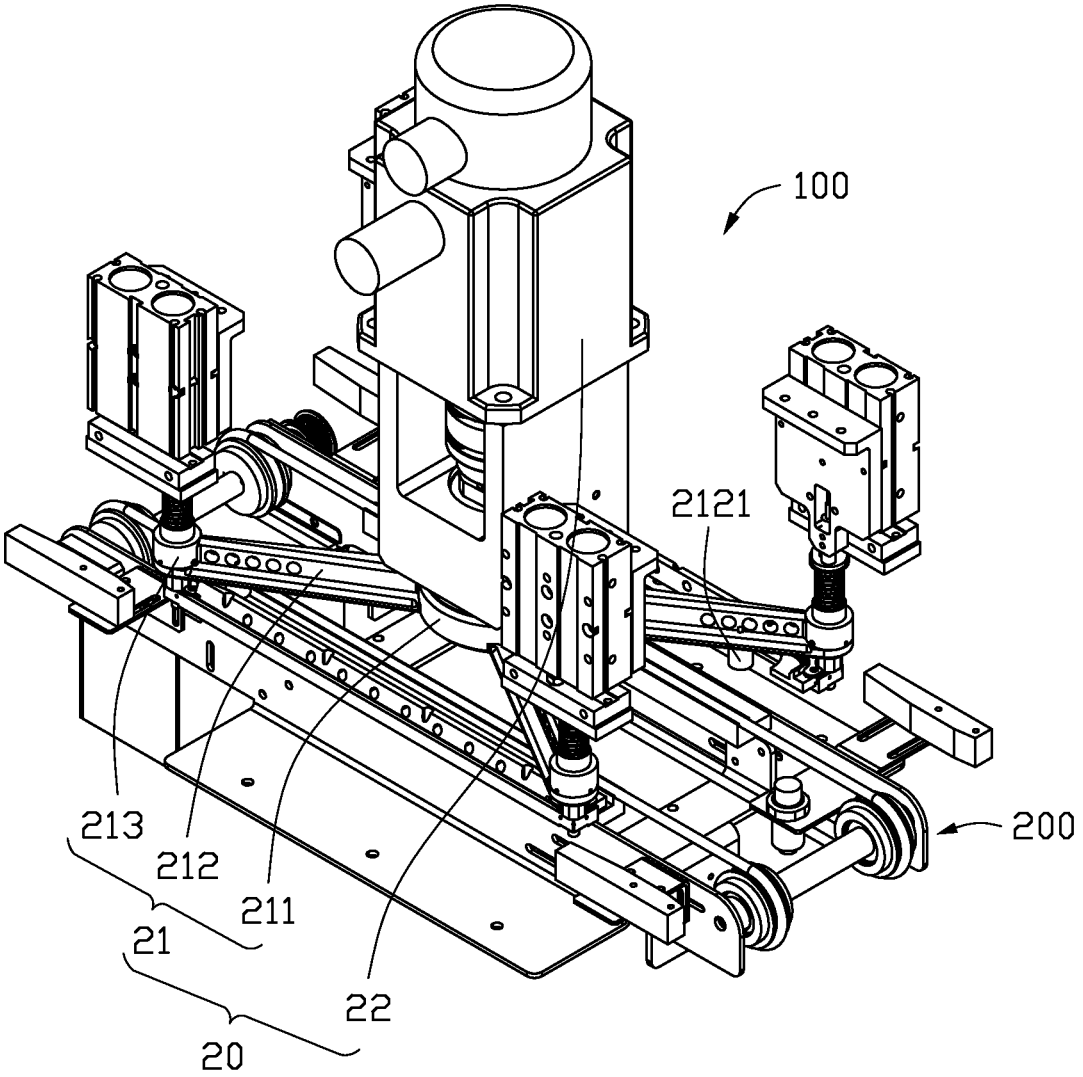
FIG. 1 is an isometric view of an embodiment of a centrifugal moisture removal device and a transporting mechanism, the centrifugal moisture removal device including a rotary driving member and a line driving member.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

The present disclosure is described in relation to a centrifugal moisture removal device which can include a rotating mechanism and a fixing mechanism. The rotating mechanism can include a rotating bracket and a rotary driving member. The rotary driving member can be mounted on the rotating bracket and configured to rotate the rotating bracket. The rotating bracket can include two sleeving portions. The fixing mechanism can include a clamping assembly and two line driving members. The clamping assembly can include a positioning member and two clamping subassemblies. The two clamping subassemblies can be mounted on two ends of the positioning member. Each clamping subassembly can include a moving staff, an elastic member, and a sensing member. A first end portion of the moving staff can pass through a sleeving portion and be coupled to the positioning member. The elastic member can be sleeved on the moving staff. A first end portion of the elastic member can resist the sleeving portion and a second end portion of the elastic member can resist a second end portion of the moving staff which is away from the sleeving portion, to enable the positioning member to move towards the rotating bracket. The sensing member can be configured to indicate the transportation of the workpieces to the positioning member. Each line driving member can be positioned above the second end portion of a moving staff which is away from the positioning member. The line driving member can be configured to compress the moving staff to move the positioning member away from the rotating bracket.

FIGS. 1-4 illustrate an embodiment of a centrifugal moisture removal device 100. The centrifugal moisture removal device 100 can be configured to remove residual water on workpieces (not shown). The centrifugal moisture removal device 100 can be set above a transporting mechanism 200 when in use. The centrifugal moisture removal device 100 can include a rotating mechanism 20, a fixing mechanism 50, and a mounting bracket (not shown). The rotating mechanism 20 can be mounted on the mounting bracket. The fixing mechanism 50 can be moveably sleeved on the rotating mechanism 20. The transporting mechanism 200 can transport the workpieces to the centrifugal moisture removal device 100. The fixing mechanism 50 can clamp and hold the workpieces. The rotating mechanism 20 can be configured to rotate the workpieces to remove residual water on the workpieces.

The rotating mechanism 20 can include a rotating bracket 21 and a rotary driving member 22. The rotating bracket 21 can be substantially "X" shaped. The rotating bracket 21 can include a mounting portion 211, four supporting arms 212, and four sleeving portions 213. The mounting portion 211 can be substantially cylindrical. A first end portion of each supporting arm 212 can be mounted on an edge of the mounting portion 211. The supporting arms 212 can be separately arranged around the mounting portion 211. A surface of each of the supporting arms 212 adjacent to the transporting mechanism 200 can define a protecting member 2121. The protecting members 2121 can be configured to clamp the workpieces. Each sleeving portion 213 can be mounted on a second end portion of a supporting arm 212 away from the mounting portion 211. Each protecting member 2121 can be mounted adjacent to a sleeving portion 213. The rotary driving member 22 can be mounted on the mounting bracket. The rotary driving member 22 can be coupled to the mounting portion 211 to rotate the rotating bracket 21. In at least one embodiment, the protecting member 2121 can be made of bakelite material to avoid the workpieces being scratched.

Figure 2:
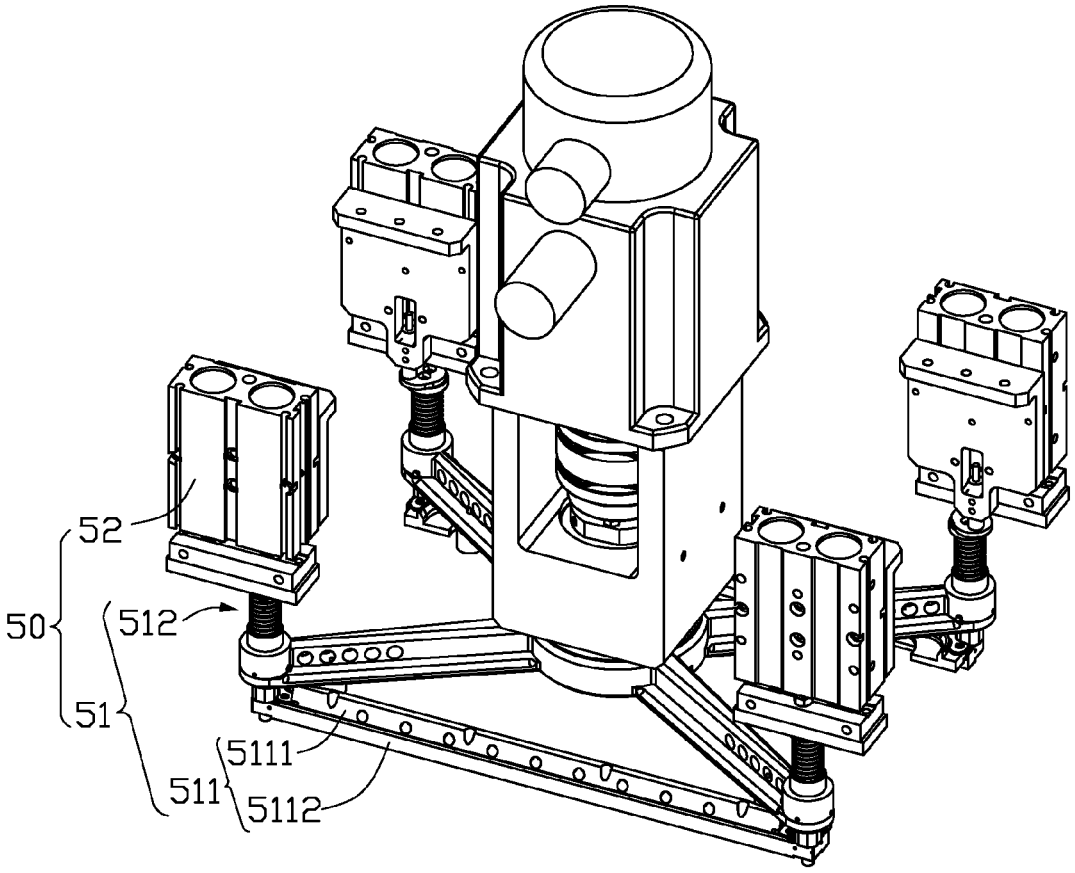
FIG. 2 is an isometric view of the centrifugal moisture removal device of FIG. 1.
Figure 3:
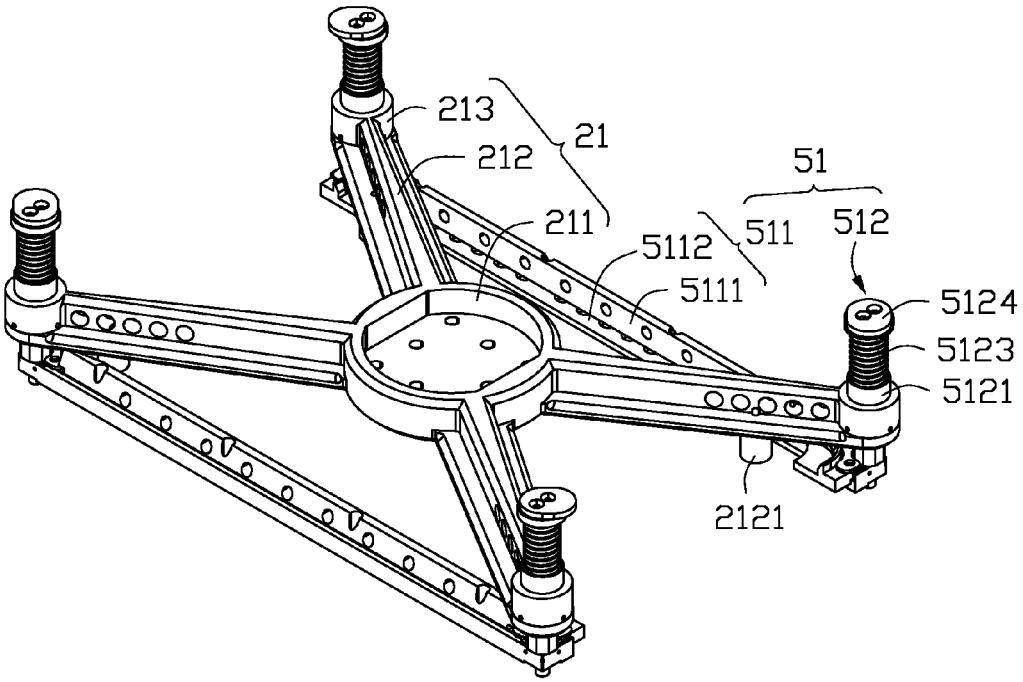
FIG. 3 is an isometric view of the centrifugal moisture removal device without the rotary driving member and the line driving member of FIG. 1.

FIGS. 2-3 illustrate that the fixing mechanism 50 can include a clamping assembly 51 and four line driving members 52. The clamping assembly 51 can be coupled to the sleeving portion 213 of the rotating bracket 21. The line driving members 52 can be mounted on the mounting bracket and positioned above the clamping assembly 51. Each line driving member 52 can move a clamping assembly 51 towards a bottom surface of the rotating bracket 21.

Each clamping assembly 51 can include two positioning members 511 and four clamping subassemblies 512. Each clamping subassembly 512 can pass through a sleeving portion 213 and be positioned below a line driving member 52. The positioning member 511 can be in a shape of a bar having a step. Each positioning member 511 can include a guiding block 5111 and a positioning block 5112. The guiding block 5111 can be perpendicularly mounted on the positioning block 5112. The guiding blocks 5111 of the positioning members 511 can be parallel with each other. Each positioning block 5112 can be coupled to the exterior of a guiding block 5111. The positioning blocks 5112 of the positioning members 511 can be set in relation to each other. Two ends of each positioning block 5112 can be separately coupled to ends of two of the clamping subassemblies 512 so as to be adjacent with each other.

Figure 4:
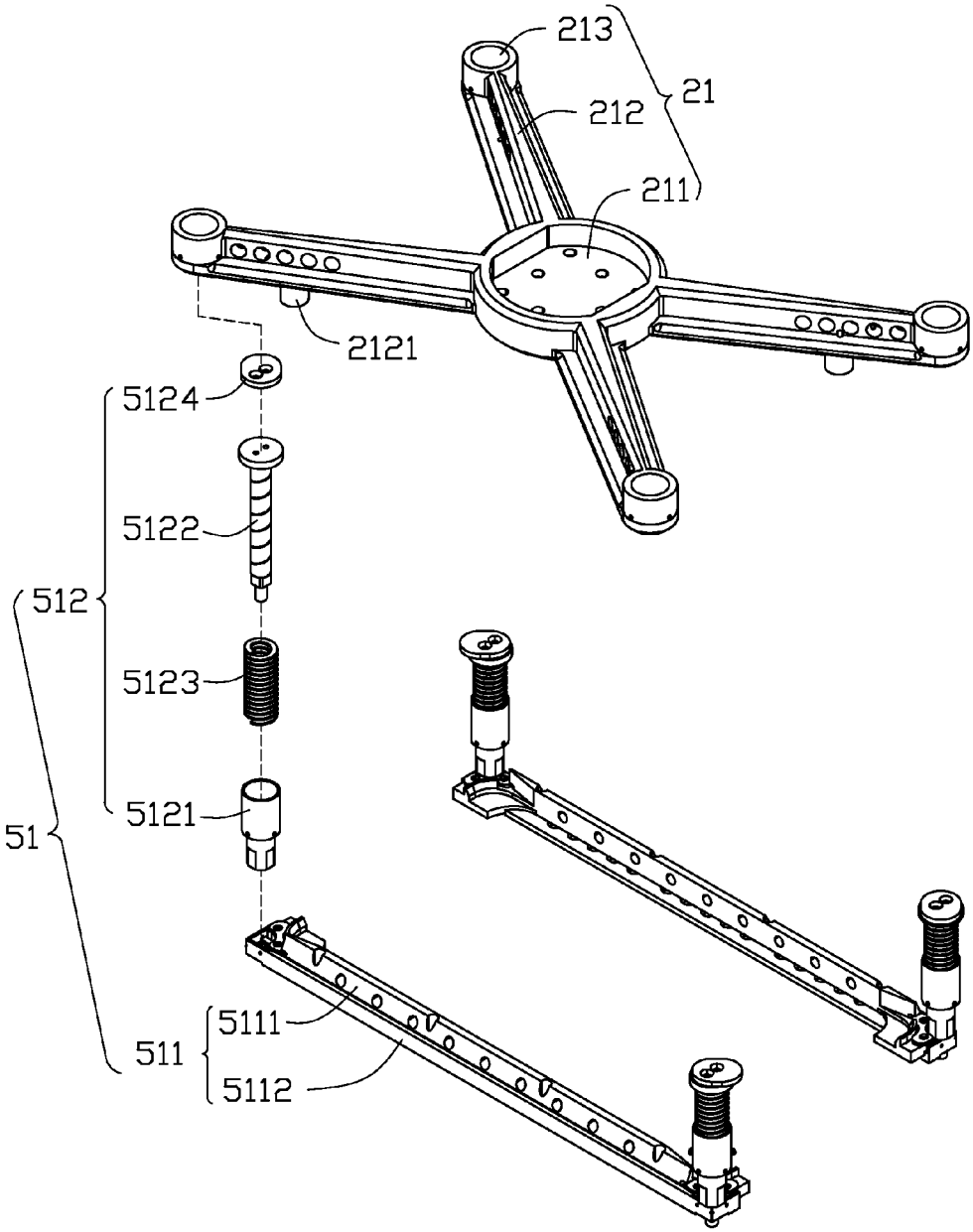
FIG. 4 is an exploded, isometric view of the centrifugal deterring device without the rotary driving member and the line driving member of FIG. 1.

FIG. 4 illustrates that each clamping subassembly 512 can include a mounting sleeve 5121, a moving staff 5122, an elastic member 5123, and a sensing member 5124. The mounting sleeve 5121 can pass through and be mounted on a sleeving portion 213. A first end portion of the moving staff 5122 can moveably pass through the mounting sleeve 5121 and be coupled to the positioning block 5112. The elastic member 5123 can be sleeved on the moving staff 5122. A first end portion of the elastic member 5123 can resist the mounting sleeve 5121. A second end portion of the elastic member 5123 can resist a second end portion of the moving staff 5122 away from the mounting sleeve 5121. The sensing member 5124 can be mounted on the second end portion of the moving staff 5122. The sensing member 5124 can sense and indicate the transportation of the workpiece to the clamping assembly 51. The sensing member 5124 can be positioned below the line driving member 52. The line driving member 52 can push the sensing member 5124 to move the moving staff 5122 relative to the rotating bracket 21. When the line driving member 52 pushes the sensing member 5124 and the moving member 5122, the elastic member 5123 is compressed and the clamping assembly 51 can be put down. When the line driving member 52 is reset, the line driving member 52 can separate from the sensing member 5124 and the moving staff 5122 to avoid limiting the rotation of the rotating bracket 21.

In assembly, the rotary driving member 22 can be mounted on the mounting portion 211 of the rotating bracket 21. Each protecting member 2121 can be mounted on a supporting arm 212. The mounting sleeve 5121 can pass through the sleeving portion 213 and be mounted on the sleeving portion 213. The elastic member 5123 can be sleeved on the moving staff 5122. The first end portion of the moving staff 5122 can moveably pass through the mounting sleeve 5121 and be coupled to the positioning block 5112. The first end portion of the elastic member 5123 can resist the mounting sleeve 5121. The second end portion of the elastic member 5123 can resist the second end portion of the moving staff 5122 away from the mounting sleeve 5121. The ends of each positioning block 5112 can be coupled to ends of two of the moving staffs 5122 adjacent with each other. The positioning member 511 and the protecting member 2121 can be set on a same side of the supporting arm 212. Thus, the protecting member 2121 can be positioned towards the positioning member 511. The sensing member 5124 can be mounted on the second end portion of the moving staff 5122 away from the mounting sleeve 5121. The line driving member 52 can be mounted on the mounting bracket. Each line driving member 52 can be positioned above a clamping member 512. Each line driving member 52 can push the sensing member 5124 to move the moving staff 5122 relative to the rotating bracket 21. The ends of one positioning member 511 can be separately mounted on the ends of two clamping subassemblies 512 away from the line driving member 52. The ends of another positioning member 511 can be separately mounted on the ends of two reset clamping subassemblies 512 away from the line driving member 52. Two positioning members 511 can be parallel with each other.

In use, the centrifugal moisture removal device 100 can be set above the transporting mechanism 200. A distance between the two positioning blocks 5112 can be greater than a distance between two sides of the transporting mechanism 200, so that the clamping assembly 51 can clamp the workpieces transported by the transporting mechanism 200 and carry the workpieces down to the transporting mechanism 200. When the line driving member 52 pushes the sensing member 5124, the elastic member 5123 is compressed and the clamping assembly 51 can go down. The transporting mechanism 200 can transport the imported workpieces to the stepped positioning members 511 along the guiding blocks 5111. The sensing member 5124 can sense the arrival of the workpieces at the positioning member 511 and then the sensing member 5124 can send a controlling signal to reset the line driving members 52. When the line driving members 52 are reset, the compressed elastic members 5123 restore. The clamping assembly 51 can clamp and lift the workpieces until the workpieces resist the protecting member 2121, so that the workpiece can be clamped between the positioning member 511 and the protecting member 2121. The rotary driving member 22 can rotate the rotating bracket 21 to rotate all the workpieces at the same time and thus remove residual water on workpieces. After a certain preset time, the rotating bracket 21 can stop rotating. The line driving member 52 can push the sensing member 5124 and the elastic member 5123 is compressed. The clamping assembly 51 can carry the workpieces down to the transporting mechanism 200 and the transporting mechanism 200 can export the workpiece.

In an alternative embodiment, the mounting bracket can be omitted, then the rotary driving member 22 can be mounted via other mechanisms. For example, the rotary driving member 22 can be mounted on the ground via a mechanism (not shown in the figures) of the transporting mechanism 200 or the rotary driving member 22 can include a supporting bracket (not shown in the figures) mounted on the floor.

In an alternative embodiment, the protecting member 2121 can be made of other soft materials to avoid the workpieces being scratched when the workpieces are clamped.

In an alternative embodiment, the protecting member 2121 can be omitted for certain sizes of workpiece, then the workpiece can be clamped between the rotating bracket 21 and the positioning member 511.

In an alternative embodiment, the mounting sleeves 5121 can be omitted, then the first end portion of the elastic member 5123 can resist the sleeving portion 213. The mounting portion 211 and the supporting arms 212 of the rotating bracket 21 can be omitted when the rotating bracket 21 is in a substantially rectangular shape and a sleeving portion 213 can be mounted on each of the four corners of the rotating bracket 21.

In an alternative embodiment, the guiding blocks 5111 can be omitted, when the transporting mechanism 200 includes a guiding device to guide the workpieces when the workpieces are being transported to the positioning blocks 5112.

In an alternative embodiment, a number of line driving members 52, clamping subassemblies 512, positioning members 511, sleeving portions 213, and sensing members 5124 can be other than four, the number of each of them can be set according to a shape of the workpieces, such that the line driving member 52 can drive the positioning member 511 and the positioning member 511 can clamp the workpieces in cooperation with the rotating bracket 21. For example, when the workpiece is in a shape of a bar, the number of line driving members 52, clamping subassemblies 512, positioning members 511, sleeving portions 213, and sensing members 5124 can be only two. The transporting mechanism 200 can transport a workpiece to two positioning members 511 and the workpiece can be clamped. In another example, when the workpiece is triangular, the number of line driving members 52, clamping subassemblies 512, positioning members 511, sleeving portions 213, and sensing members 5124 can be three, each clamping subassembly 512 can be coupled to two adjacent positioning members 511 to form a triangle. The transporting mechanism 200 can transport the workpieces to the positioning members 511 and sides of the workpiece can be parallel with the sides of three positioning members 511. The triangular workpieces can thus be clamped.

In an alternative embodiment, when the workpiece is in shape of a bar, the number of line driving members 52 and clamping subassemblies 512 can be two, there can be only one positioning member 511, and the ends of the positioning member 511 can be mounted on the ends of the clamping subassemblies 512.

In an alternative embodiment, the elastic member 5123 and the sensing member 5124 can be omitted. When the moving staff 5122 is coupled to a line driving member 52, the line driving member 52 can move the moving staff 5122 up and down. When an operator decides that the workpiece is transported to the positioning member 511, the clamping subassembly 512 can be driven to clamp the workpieces.

In an alternative embodiment, the sensing member 5124 can be set anywhere, provided that the sensing member 5124 can be configured to sense and indicate the transportation of the workpieces to the positioning members 511.

It is believed that the present embodiments and their advantages will be understood from the foregoing description, and it will be apparent that various changes can be made thereto without departing from the spirit and scope of the embodiments or sacrificing all of its material advantages.

What is claimed is:

1. A centrifugal moisture removal device comprising:

a rotating mechanism comprising:

a rotating bracket comprising two sleeving portions, and a rotary driving member mounted on the rotating bracket and configured to rotate the rotating bracket; and a fixing mechanism comprising:

a clamping assembly comprising two positioning members separated from each other and two clamping subassemblies, each positioning member coupled to a clamping subassembly, wherein each clamping subassembly comprises:

a moving staff, a first end portion of the moving staff passing through a sleeving portion and coupled to a positioning member, an elastic member sleeved on the moving staff, a first end portion of the elastic member resisting the sleeving portion and a second end portion of the elastic member resisting a second end portion of the moving staff away from the sleeving portion, to enable the positioning member to move towards the rotating bracket, and a sensing member configured to indicate the transportation of the workpieces to the positioning members;

wherein the fixing mechanism further comprises:

two line driving members, each line driving member positioned above the second end portion of a moving staff away from the positioning member, the line driving member configured to compress the moving staff to move the positioning member away from the rotating bracket.

2. The centrifugal moisture removal device of claim 1, wherein the rotating bracket comprises:

a mounting portion, and two supporting arms, a first end portion of each supporting arm is mounted on the mounting portion, each sleeving portion is mounted on a second end portion of a supporting arm.

3. The centrifugal moisture removal device of claim 2, wherein a surface of each supporting arm adjacent to the positioning member defines a protecting member.

4. The centrifugal moisture removal device of claim 2, wherein the clamping assembly further comprises two clamping subassemblies, the clamping subassemblies are coupled to the positioning member, the rotating bracket further comprises two supporting arms and two sleeving portions.

5. The centrifugal moisture removal device of claim 1, wherein the clamping subassembly further comprises a mounting sleeve moveably sleeved on the first end portion of the moving staff away from the elastic member, the mounting sleeve passes through and is coupled to the sleeving portion.

6. The centrifugal moisture removal device of claim 1, wherein the positioning member comprises a positioning block coupled to the moving staff.

7. The centrifugal moisture removal device of claim 6, wherein the positioning member further comprises a guiding block, the guiding block is substantially perpendicularly mounted on the positioning block.

8. A centrifugal moisture removal device comprising:

a rotating mechanism comprising:

a rotating bracket comprising three sleeving portions, and a rotary driving member mounted on the rotating bracket and configured to rotate the rotating bracket; and a fixing mechanism comprising:

a clamping assembly comprising two positioning members separated from each other and three clamping subassemblies, two of the clamping subassemblies mounted on one of the positioning members, the another one of the clamping subassemblies mounted on another one of the positioning members, wherein each clamping subassembly comprises:

a moving staff, a first end portion of the moving staff passing through a sleeving portion and coupled to a positioning member, an elastic member sleeved on the moving staff, a first end portion of the elastic member resisting the sleeving portion and a second end portion of the elastic member resisting a second end portion of the moving staff away from the sleeving portion, to enable the positioning member to move towards the rotating bracket, and a sensing member configured to indicate the transportation of the workpieces to the positioning members, wherein the fixing mechanism further comprises:

three line driving members, each line driving member positioned above the second end portion of a moving staff away from the positioning member, the line driving member configured to compress the moving staff to move the positioning member away from the rotating bracket.

9. The centrifugal moisture removal device of claim 8, wherein the rotating bracket comprises:

a mounting portion, and three supporting arms, a first end portion of each supporting arm is separately mounted on the mounting portion, each sleeving portion is mounted on a second end portion of a supporting arm away from the mounting portion.

10. The centrifugal moisture removal device of claim 9, wherein a surface of each supporting arm adjacent to the positioning member defines a protecting member.

11. The centrifugal moisture removal device of claim 9, wherein the clamping assembly further comprises one clamping subassembly, the clamping subassembly is mounted on the positioning member mounted with one clamping subassembly, the rotating bracket further comprises one supporting arms and one sleeving portion.

12. The centrifugal moisture removal device of claim 8, wherein the clamping subassembly further comprises a mounting sleeve moveably sleeved on the first end portion of the moving staff away from the elastic member, the mounting sleeve passes through and is coupled to the sleeving portion.

13. A centrifugal moisture removal device comprising:

a rotating mechanism comprising:

a rotating bracket comprising two sleeving portions, and a rotary driving member mounted on the rotating bracket and configured to rotate the rotating bracket; and a fixing mechanism comprising:

a clamping assembly comprising two clamping subassemblies and a positioning member coupled to the clamping subassemblies, wherein each clamping member comprises:

a moving staff, a first end portion of the moving staff passing through a sleeving portion and coupled to the positioning member, and an elastic member sleeved on the moving staff, a first end portion of the elastic member resisting the sleeving portion and a second end portion of the elastic member resisting a second end portion of the moving staff away from the sleeving portion to enable the positioning member to move towards the rotating bracket, wherein the fixing mechanism further comprise:

two line driving members, each line driving member positioned above the second end portion of a moving staff away from the positioning member, the line driving member configured to compress the moving staff to move the positioning member away from the rotating bracket.

14. The centrifugal moisture removal device of claim 13, wherein the clamping subassembly further comprises a sensing member mounted on the second end portion of the moving staff and configured to indicate the transportation of the workpieces to the positioning member.

15. The centrifugal moisture removal device of claim 13, wherein the rotating bracket comprises:

a mounting portion, and two supporting arms, a first end portion of each supporting arm is mounted on the mounting portion, each sleeving portion is mounted on a second end portion of a supporting arm.

16. The centrifugal moisture removal device of claim 15, wherein a surface of each supporting arm adjacent to the positioning member defines a protecting member.

17. The centrifugal moisture removal device of claim 15, wherein the clamping assembly further comprises a positioning member and two clamping subassemblies, each positioning member is coupled to two clamping subassemblies, the rotating bracket further comprises two supporting arms and two sleeving portions.

18. The centrifugal moisture removal d of claim 13, wherein the clamping subassembly further comprises mounting sleeve moveably sleeved on the first end portion of the moving staff away from the elastic member, the mounting sleeve passes through and is coupled to the sleeving portion.

19. The centrifugal moisture removal device of claim 13, wherein the positioning member comprises a positioning block coupled to the moving staffs.

20. The centrifugal moisture removal device of claim 19, wherein the positioning member further comprises a guiding block, the guiding block is substantially perpendicularly mounted on the positioning block.

* * * * *